United States Patent [19]

Winston

[11] Patent Number: 4,817,526

[45] Date of Patent: Apr. 4, 1989

[54] ROLLING CONTACT PRINTER WITH RETRACTABLE INKING WHEEL

[76] Inventor: Jeffrey M. Winston, 658 W. Shore Dr., Anacortes, Wash. 98221

[21] Appl. No.: 111,772

[22] Filed: Oct. 22, 1987

[51] Int. Cl.[4] ..... B41K 1/38

[52] U.S. Cl. ..... 101/329; 401/107

[58] Field of Search ..... 101/328, 329, 330, 331; 401/107

[56] References Cited

U.S. PATENT DOCUMENTS

| | | | |
|---|---|---|---|
| 209,763 | 11/1878 | Keeler | 101/329 |
| 321,223 | 6/1885 | Keeler . | |
| 427,229 | 5/1890 | French . | |
| 642,367 | 1/1900 | Ray . | |
| 749,034 | 1/1904 | Daut | 401/218 |
| 829,230 | 8/1906 | Pope . | |
| 1,070,763 | 8/1913 | Bauman . | |
| 1,127,806 | 2/1915 | Pells . | |
| 1,291,057 | 1/1919 | Marks | 101/103 |
| 1,576,791 | 3/1926 | Rosner . | |
| 1,656,489 | 1/1928 | Low . | |
| 1,909,326 | 5/1933 | Wheeler, Jr. . | |
| 2,576,622 | 11/1951 | McBride | 401/219 |
| 3,465,673 | 9/1969 | Oppenheim . | |
| 3,859,915 | 1/1975 | Hunter | 101/103 |
| 4,181,560 | 1/1980 | Maitland | 101/103 |
| 4,259,568 | 3/1981 | Dynesen | 400/88 |
| 4,367,965 | 1/1983 | Speitel | 401/108 |

FOREIGN PATENT DOCUMENTS

| | | | |
|---|---|---|---|
| 231631 | 11/1909 | Fed. Rep. of Germany | 401/107 |
| 551219 | 5/1932 | Fed. Rep. of Germany | 401/108 |
| 551947 | 6/1932 | Fed. Rep. of Germany | 101/329 |
| 1259732 | 1/1968 | Fed. Rep. of Germany | 401/107 |
| 451645 | 9/1949 | Italy | 101/103 |
| 151703 | 12/1931 | Switzerland | 101/103 |

*Primary Examiner*—Clifford D. Crowder

*Attorney, Agent, or Firm*—Hughes, Cassidy & Multer

[57] ABSTRACT

A printing device for printing a continuous strip of indicia. The printing device comprises a housing defining a handle and an operating end portion. The operating end portion defines a print wheel cavity adapted to carry a print wheel with an outer circumferential printing surface for rotation about a wheel axis. An inking assembly comprising an ink housing and an inking roller is moveable between a first forward position where the inking roller is in contact with the print wheel and a second retracted position where the inking roller is spaced from the print wheel. A spring is mounted in the housing which is adapted to urge the inking roller toward the first forward position and releasable retaining structure positioned on the ink housing is adapted to hold the inking assembly in the second retracted position.

18 Claims, 6 Drawing Sheets

6
6
10
12
14
16
18
20
22
24
26
28
30
32
36
38
40
42
45
46
48
50
52
54
56
58
60
82
84
86
94
98
118
120

ROLLING CONTACT PRINTER WITH RETRACTABLE INKING WHEEL

BACKGROUND OF THE INVENTION (a) Field of the Invention

The present invention relates generally to a printing device, and, in particular to a printing device for printing a continuous strip of indicia.

(b) Background Art

There are numerous situations in which people desire to print a continuous pattern on paper, cloth or the like for decorative or utilitarian purposes. Examples range from making decorative wrapping paper to printing a repetitious pattern or message across a form, letter or other paper or material. Problems arise when this becomes a messy, time consuming job with a printing device that requires continual application of ink from a separate ink pad or where the print wheel or ink cartridge is exposed so that those using the device can easily get ink on their clothes or their person. Other problems arise when the ink cartridge is not retractable from the print wheel to allow for easy cleaning of the device or the changing of patterns and ink colors is impossible or inconvenient. Several prior art devices have not worked well due to various mechanical and inherent material problems.

A search of the U.S. patent literature has disclosed a number of prior art patents, these being as follows:

U.S. Pat. No. 3,465,673 to Oppenheim, discloses a hand painting toy which uses a snap-in print wheel.

U.S. Pat. No. 1,909,326 to Wheeler Jr., shows a rotary hand canceler which has a bracket which holds an inking roller which may be removed and re-inked.

U.S. Pat. No. 1,656,849 to Low, shows a printing device with an ink roller mounted in side slots positioned near the handle. The print wheel in Low is in continual contact with the inking roller and is not retractable.

U.S. Pat. No. 1,576,791 to Rosner, teaches a fur marker which carries a chalk like substance and distributes the chalk to the marking device.

U.S. Pat. No. 1,127,806 to Pells et al., shows a printing device having a handle and a spring loaded ink roller wherein the spring is adjustable. In Pells et al. also, the print wheel is not retractable from the inking roller.

U.S. Pat. No. 1,070,763 to Bauman et al., discloses a print roller device.

U.S. Pat. No. 829,230 to Pope, discloses a canceling device in which the ink roller pressure is adjusted by a nut which withdraws a screw positioned within a spring.

U.S. Pat. No. 642,367 to Ray et al., shows a roller marker with an ink roller held in position by a spring.

U.S. Pat. No. 427,229 to French, discloses a printing wheel with two wheel paths for printing letters in two different colors.

U.S. Pat. No. 321,223 to Keeler, discloses a printing wheel having a spring loaded ink roller.

SUMMARY OF THE INVENTION

The present invention provides a printing device which overcomes the before described problems inherent in the prior art devices. The present printing device comprises a housing defining a handle and an operating end portion. The operating end portion defines a print wheel cavity. The print wheel has an outer circumferential printing surface and is mounted in the print wheel cavity so that as the print wheel rotates, only the part of the outer circumferential printing surface that moves across the paper or material is exposed. An inking assembly comprising an ink housing and an inking roller is positioned in the housing. The inking assembly is moveable between a first forward position where the inking roller is in contact with the print wheel and a second retracted position where the inking roller is spaced from the print wheel. Spring means are provided which are positioned in the housing, the spring means being adapted to urge the inking roller toward the first forward position such that the inking roller remains in contact with the print wheel as the device is printing. Releasable retaining means are positioned on the ink housing to hold the inking assembly in the second retracted position and, when not in use, the inking assembly is retractable so as not to come in contact with the print wheel; and in its retracted position the inking assembly is not exposed so as to provide a clean, easy to operate printing device. The inking assembly is mounted so that it remains properly engaged with the print wheel in a manner to allow for any misalignment.

It is therefore an object and advantage of the present invention to provide a printing device for printing a continuous strip of indicia which is simple and clean to use.

It is a further object and advantage of the present invention to provide a printing device that has a removable and coverable inking roller so that when the device is not in use the ink supply may be covered to prevent it from drying up.

It is still another object and advantage of the present invention to provide a printing device that has quickly interchangeable inking rollers so that different colored inks may be easily used.

It is still yet another object and advantage of the present invention to provide a printing device that has quickly interchangeable print wheels so that different sizes and patterns of indicia may be easily printed.

It is another object and advantage of the present invention to provide a printing device that has a retractable inking roller so that the print wheel may be easily cleaned.

It is another object and advantage of the present invention to provide a printing device which has a free floating inking assembly with an inking roller which positions against all portions of the print wheel as it rotates so that the printed indicia does not skip.

It is another object and advantage of the present invention to provide a printing device which is easy and inexpensive to manufacture.

DESCRIPTION OF THE PREFERRED EMBODIMENT

Figure 1:
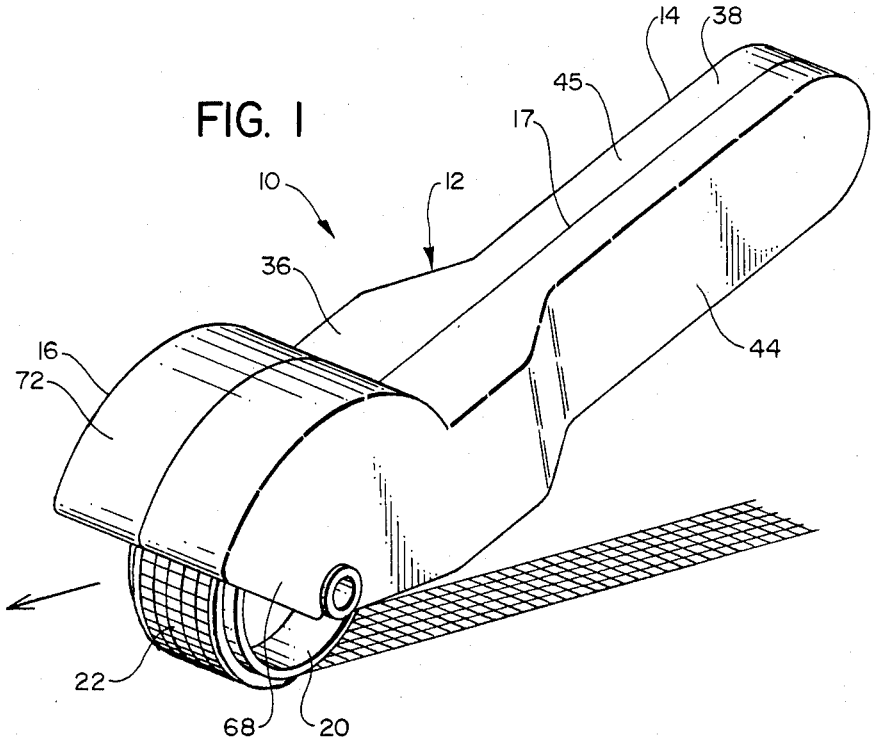
FIG. 1 is a top perspective view of the present printing device.
Figure 3:
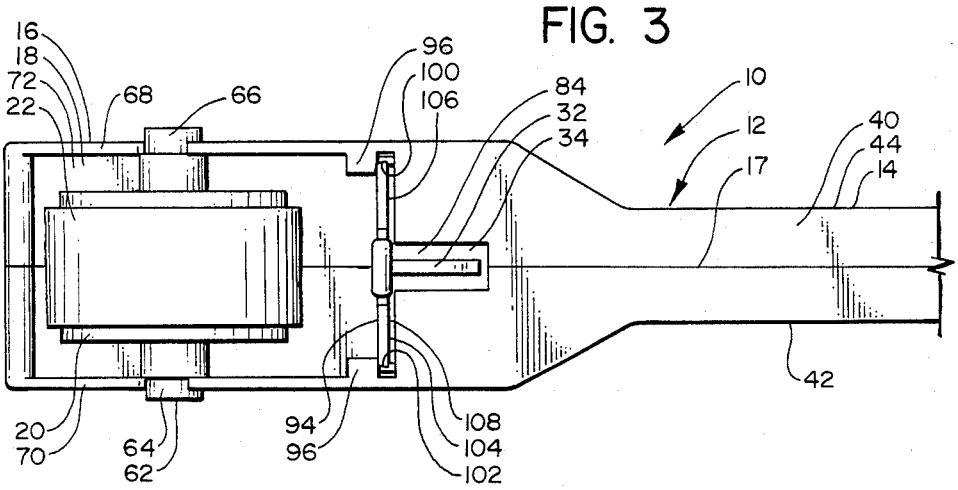
FIG. 3 is a bottom plan view of the present printing device.
Figure 2:
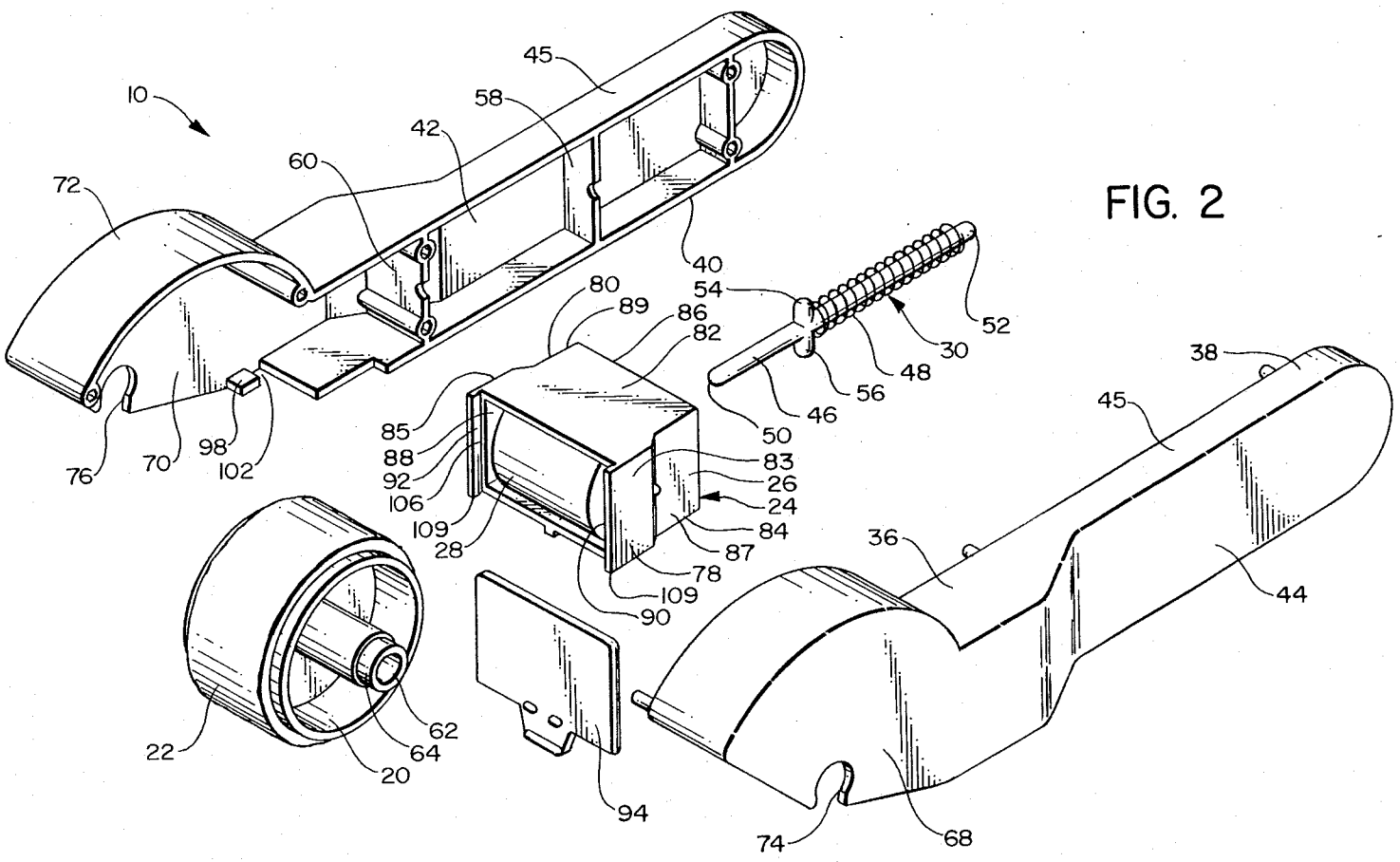
FIG. 2 is an exploded view showing the parts of the printing device.

Referring now to the drawings in general there is shown a printing device shown generally by the numeral 10. The printing device 10 comprises a housing 12 which comprises a handle 14 and an operating end portion 16. For purposes of description, the device 10 shall be considered as having a longitudinal center axis 17 which extends from the front to the rear of the device. The terms "inner" or "inward" will denote a direction toward, or proximity to, the longitudinal center axis 17, while the terms "outer" or "outward" will denote a location further from, or a direction away from, the longitudinal center axis 17. The operating end portion 16 defines a print wheel cavity 18. The print wheel 20 of the device 10 is adapted to be mounted in the housing 12 in the print wheel cavity 18 for rotation about a horizontally aligned, transverse wheel axis. The print wheel 20 has an outer circumferential printing surface 22 such that as the printing device 10 is pushed forwardly as shown in FIG. 1 the outer circumferential printing surface 22 moves across the paper or material to be printed and the pattern from the outer circumferential printing surface 22 is printed onto the paper or the like.

Figures 4, 5:
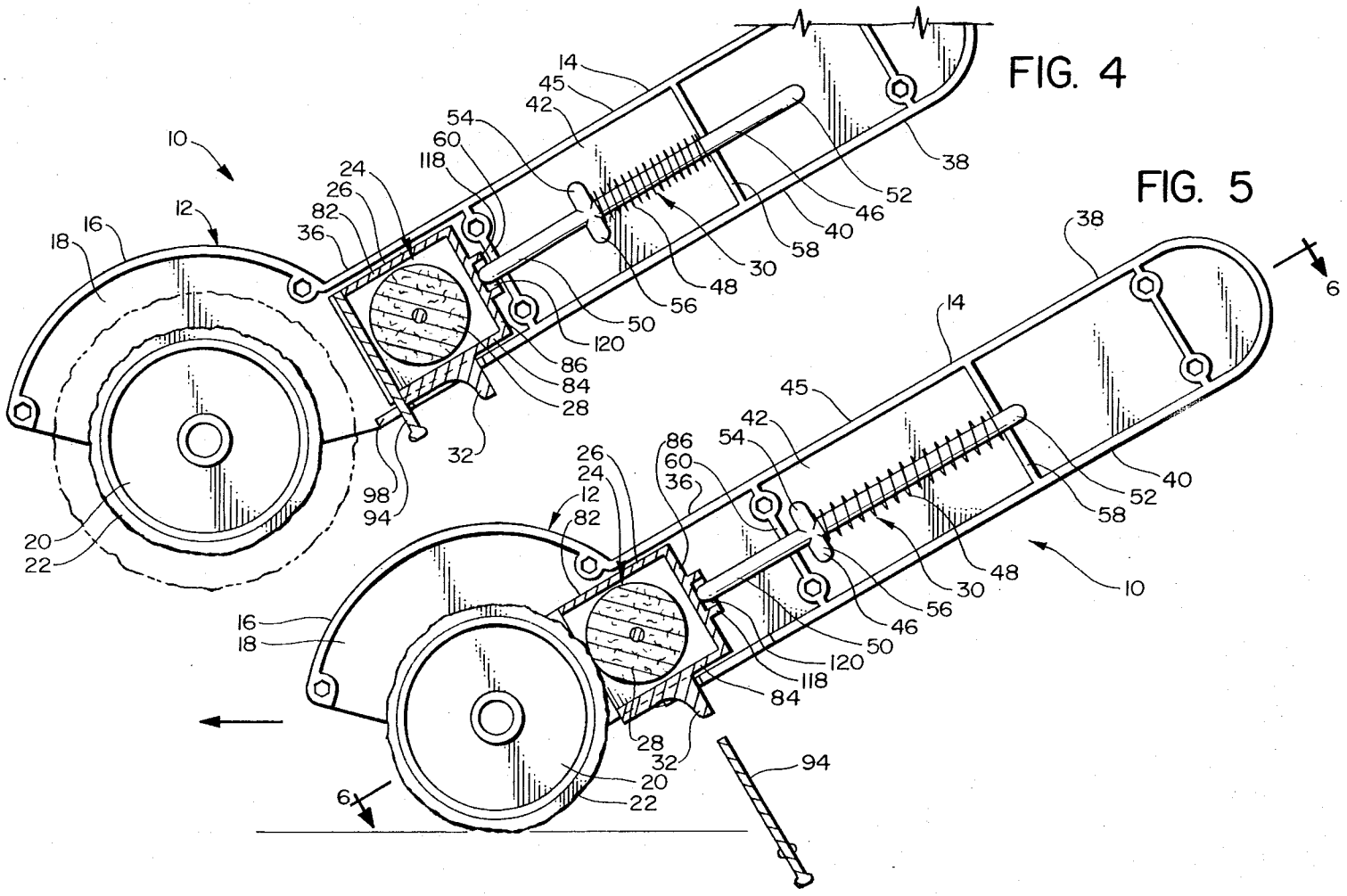
FIG. 4 is a cross-sectional view taken through the longitudinal center axis of the device showing the inking roller retracted from the print wheel and the lid positioned over the inking assembly housing in a cleaning or storage position.
FIG. 5 is a cross-sectional view taken through the longitudinal center axis showing the lid removed from the inking assembly housing and the inking roller engaged with the print wheel.

An inking assembly 24 which comprises an ink housing 26 and an inking roller 28 is positioned in the housing 12. The inking assembly 24 is moveable between a first forward position as shown in FIG. 5 where the inking roller 28 is in contact with the print wheel 20 and a second retracted position as shown in FIG. 4 where the inking roller 28 is spaced from the print wheel 20. Spring means 30 are mounted in the housing 12 and are adapted to urge the inking roller 28 toward the first forward position as shown in FIG. 5. A releasable retaining means partly in the form of a lever 32 is positioned on the ink housing 26 and is adapted to hold the inking assembly 24 in the second retracted position wherein the print wheel 20 is spaced from the inking roller 28. The lever 32 extends out through a slot 34 in the handle 14 of the printing device 10.

The housing 12 defines an easily gripped handle 14 adapted to be held so that the print wheel 20 is easily rotatable across a flat surface. The operating end portion 16 of the housing 12 which defines a print wheel cavity 18 covers the portion of the print wheel 20 which is not being rotated across the flat surface, serving to keep the print wheel 20 unexposed to those using the device 10.

The handle 14 has a forward portion 36, a rear portion 38, a lower wall 40, two side walls 42 and 44 and a top wall 45. In the middle and forward portion 36 of the handle 14 there is positioned the spring means 30 in the form of a crosspin 46 and a spring 48. The crosspin 46 has a forward end 50, a rear end 52, and stop fingers 54 and 56. In the rear portion 38 of the handle 14 between the two side walls 42 and 44 there is a rear plate 58 which forms a seat for the spring 48 and in the forward portion 36 of the handle 14 there is a forward stop wall 60.

The print wheel 20 rotates on an axle 62. The axle 62 has circumferential grooves at the end portions 64 and 66. The operating end portion 16 of the device 10 which defines the print wheel cavity 18 has two generally semi-circularly shaped side walls 68 and 70 and a curved top wall 72 adapted to accommodate the circular configuration of the print wheel 20. The side walls 68 and 70 of the operating end portion 16 each have a recess 74 and 76 adapted to receive and interfit with the circumferential grooves of the end portions 64 and 66 of the axle 62 upon which the print wheel 20 rotates. In this way, the ends 64 and 66 of the axle 62 have a snap in fit into the recesses 74 and 76 in the side walls 68 and 70 of the print wheel cavity 18 of the device 10. Thus, print wheels of varying circumferential dimension can be quickly interchangeably positioned within the print wheel cavity 18.

The ink housing 26 of the inking assembly 24 has two side walls 78 and 80, generally flat top and bottom walls 82 and 84, a rear wall 86, and an open front portion 88. The side walls 78 and 80 have forward portions 83 and 85 which extend laterally outwardly relative to the rear wall 86, and indented rear portions 87 and 89 which extend laterally inwardly relative to the forward portions 83 and 85. The two side walls 78 and 80 have front edge portions which extend slightly beyond the front edges of the top and bottom walls 82 and 84 thereby forming the front flanges 90 and 92 on the side walls 78 and 80.

The inking assembly 24 which comprises an ink housing 26 and an inking roller 28 also includes a closure plate 94 which is removably positioned at the open front portion 88 of the inking assembly 24 when the device 10 is not in use. The releasable retaining means comprises the lever 32 which is fixedly connected to the bottom wall 82 of the ink housing 26 rearwardly of the front edge thereof and extends downwardly through the slot 34 in the handle 14 of the device 10, and also comprises catch means in the form of two catch members 96 and 98 which are positioned at the lower edge of the two side walls 68 and 70 of the operating end portion 16 of the device. The two catch members 96 and 98 extend laterally toward one another and define notches 100 and 102. There is a pair of vertical slots 104 and 106 formed in the laterally inwardly facing surface of flanges 90 and 92. The slots 104 and 106 collectively form a slideway 108 to receive the closure plate 94. The closure plate 94 can be placed through the slideway 108 in the handle 14 to enclose the inking roller 28 within the ink housing 26.

Figure 8A:
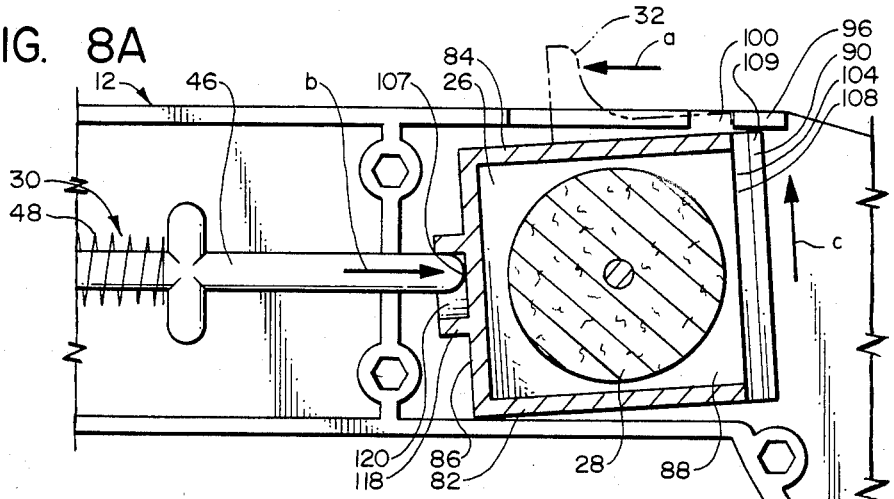
FIGS. 8A–D are side views showing details on the operation of the releasable retaining means.

The manner in which the inking assembly 24 can be moved between its forward position and its retracted position will now be described with reference to FIGS. 8A–8D. It should be kept in mind that in FIGS. 8A–8D the device 10 is inverted so that the lower side is positioned in an upper position. As indicated previously, "inward" will denote proximity to the longitudinal center axis 17 of the device 10 and "outward" will denote a location further away from the longitudinal center axis 17 of the device 10. There is illustrated in FIG. 8A the situation where the ink housing 26 is being moved rearwardly by the user exerting a rearward force (indicated at "a" on the level 32). This can conveniently be accomplished by the user grasping the handle with the fingers of the hand and operating the lever 32 by the thumb. This rearwardly directed force "a" is resisted by a forwardly directed force "b" exerted at the contact point 107 of the spring loaded crosspin 46 pushing against the rear wall 86 of the ink housing 26 at a central location. It can readily be seen that since the two forces "a" and "b" are horizontally directed and vertically offset from one another, there is a force couple created so that there is a resultant inward force "c" which causes the upper edges 109 of the flanges 90 and 92 to bear against the lower surface of the catch members 96 and 98. (In FIG. 8A the ink housing 26 has already been moved almost to its full retracted position).

Figure 8B:
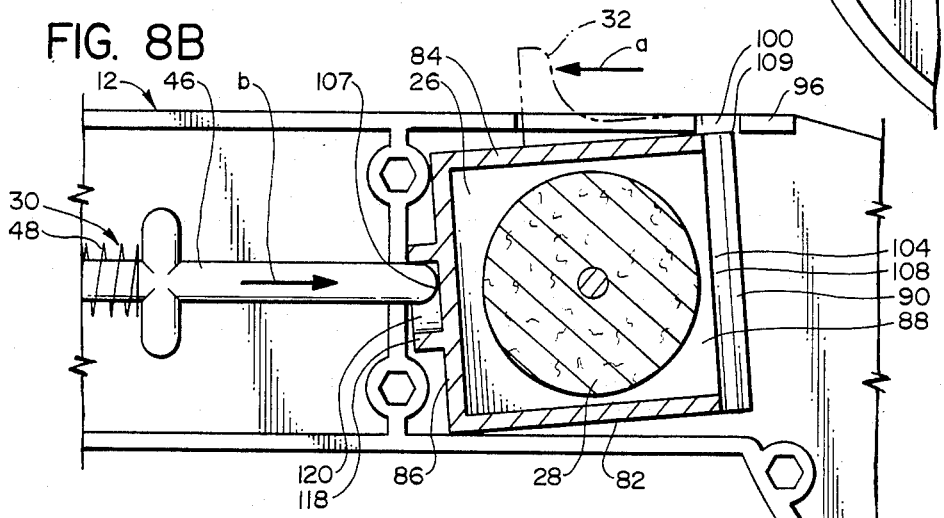

As soon as the lower edges 109 of the flange mbers 90 and 92, which are in an inward position in FIGS. 8A–8D, clear the catch members 96 and 98, as shown in FIG. 8B, these lower flange portions move into the notches 100 and 102 directly behind the catch members 96 and 98, because of the force "c". The lower wall of the housing 12 which is shown in an upper position, prevents further outward movement of the lower forward part of the ink housing 26. As the flanges 90 and 92 snap into retaining engagement with the rear surface of the catch members 96 and 98, the adjacent side of the slots 104 and 106 that collectively form the slideway 108 remain aligned with the notches 100 and 102 and thus open for positioning of the closure plate 94 thus the closure plate 94 may be inserted in the slideway 108 so as to be positioned to close the open front portion 88 of the inking housing 26 when the inking assembly 24 is in its retracted position thereby allowing the closure plate 94 to be secured in position when the inking assembly 24 is in its retracted position.

Figure 8C:
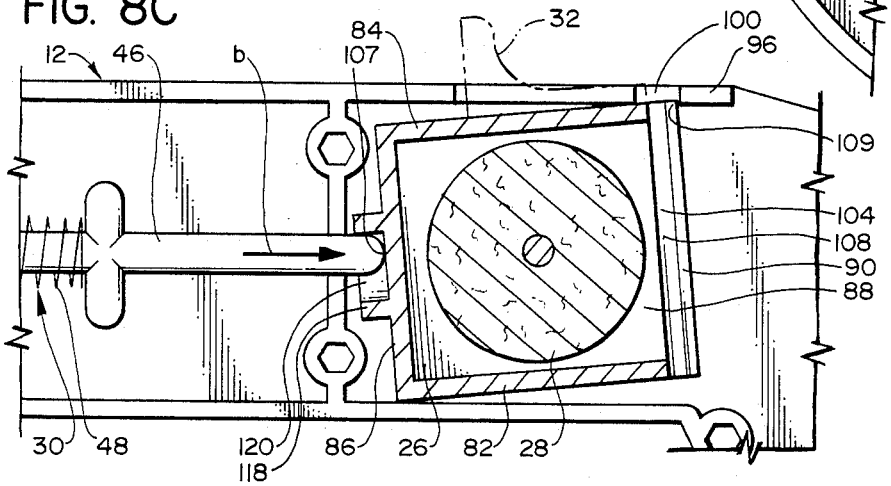

As illustrated in FIG. 8C, when the person releases the rearward force on the lever 32, the urging of the spring 48 causes the crosspin 46 to act against the ink housing 26 to push it forwardly so that the lower flanges that are adjacent to the catch members 96 and 98 engage the rear surface of the catch members 96 and 98. Thus, the ink housing 26 is held in its retracted position.

Figure 8D:
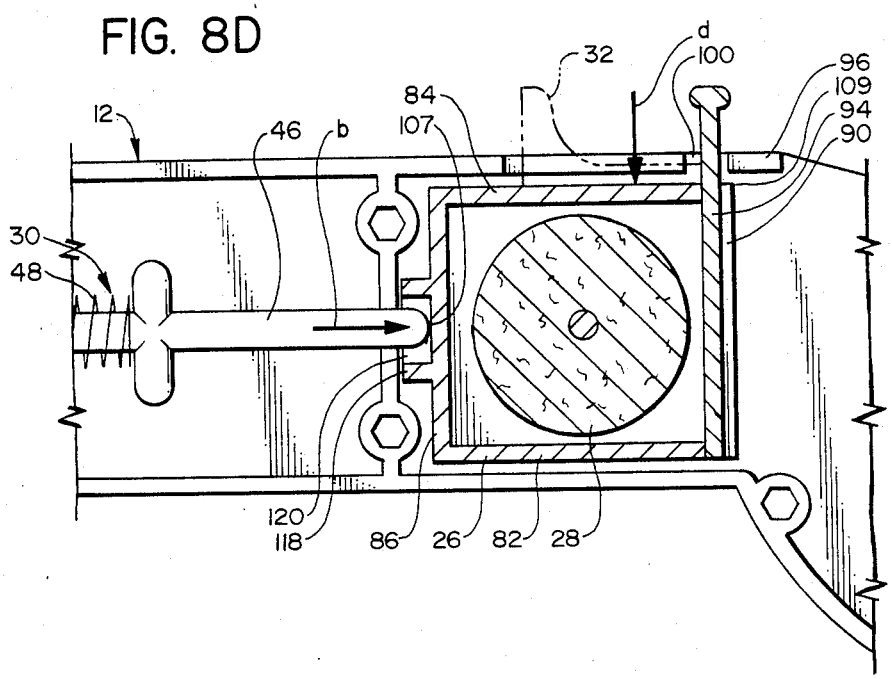

As illustrated in FIG. 8D, when it is desired to move the ink housing 26 forwardly from the retracted position, the person removes the closure plate 94 and then the person pushes inwardly with a force "d" directed at the handle surface directly above the lower forward edge of the ink housing 26. This causes the lower forward edge portions 109 of the side flanges 90 and 92 to move inwardly so as to be clear of the catch memlers 96 and 98, and the urging of the spring 48 causes the ink housing 26 to move forwardly. However, in the usual situation where the person is grasping the handle 14 in the fingers of the hand with the thumb manipulating the lever 32 and also pushing the front lower edge of the ink housing 26 inwardly to its released position, the lever 32 will come into engagement with the person's thumb after the ink housing 26 has moved a short distance forwardly. Then the person supply moves his or her thumb out of the way to permit further forward movement of the ink housing 26 and thus permit the inking roller 28 to come into proper engagement with the print wheel 20.

As illustrated in FIG. 4, then, with the device 10 in its retracted position, the closure plate 94 is positioned through the slideway 108 and over the inking assembly 24 so that the inking roller 28 is enclosed, and the plate 94 prevents the inking assembly 24 from moving into its forward position, even if it becomes disengaged from the catch members 96 and 98. I the retracted position with the inking roller 28 spaced apart from the print wheel 18, the print wheel 18 may be easily cleaned by running the print wheel 18 along a flat surface repeatedly, until the entire outer circumferential printing surface 22 has the ink removed.

In the preferred form, the inking assembly 24 including the closure plate 94 is removable from the housing 12. To remove the inking assembly 24 from the housing 12, the print wheel 20 is removed from the print wheel cavity 18 and the front lower edge of the ink housing is pushed inwardly as shown in Figure 8D to enable the ink housing 26 to move forwardly and thus move into the print wheel cavity 18 previously occupied by the print wheel 20. In this way, the inking roller 28 can be removed to be re-inked or to change the color of the ink by changing the inking assembly 24. The removable inking assembly 24 also serves as an appropriate storage container for the inking roller 28 so that when not in use, with the closure plate 94 positioned over the inking assembly 24 the inking roller 28 does not dry out.

The inking roller 28 has a hole 110 positioned therethrough at substantially the longitudinal center axis 112 of the inking roller 28. A shaft 114 of substantially the same diameter as the hole 110 is positioned through the hole 110 in the inking roller 28 so that the inking roller 28 sits firmly within the ink housing 26.

Figure 6:
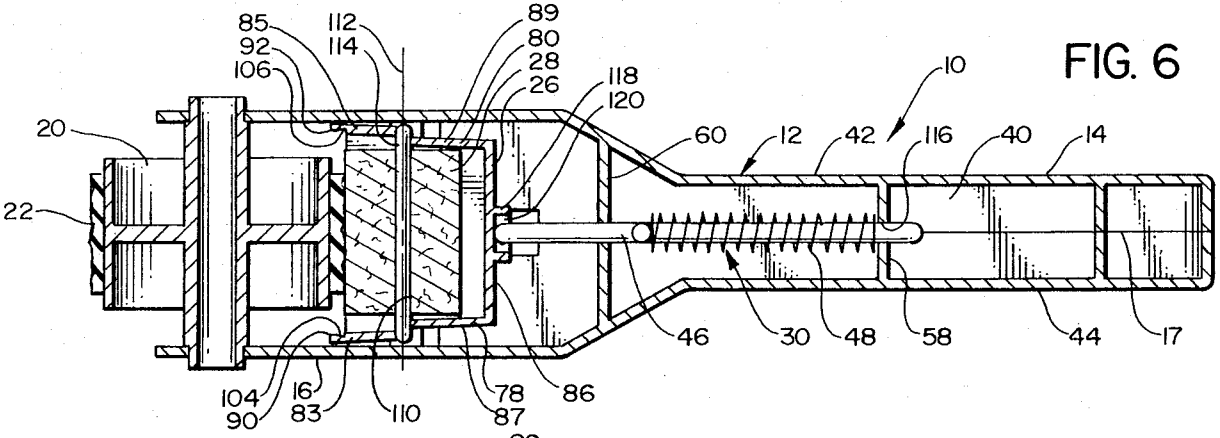
FIG. 6 is a side cross-sectional view taken through the longitudinal center axis showing the inking roller engaged with the print wheel.
Figure 7:
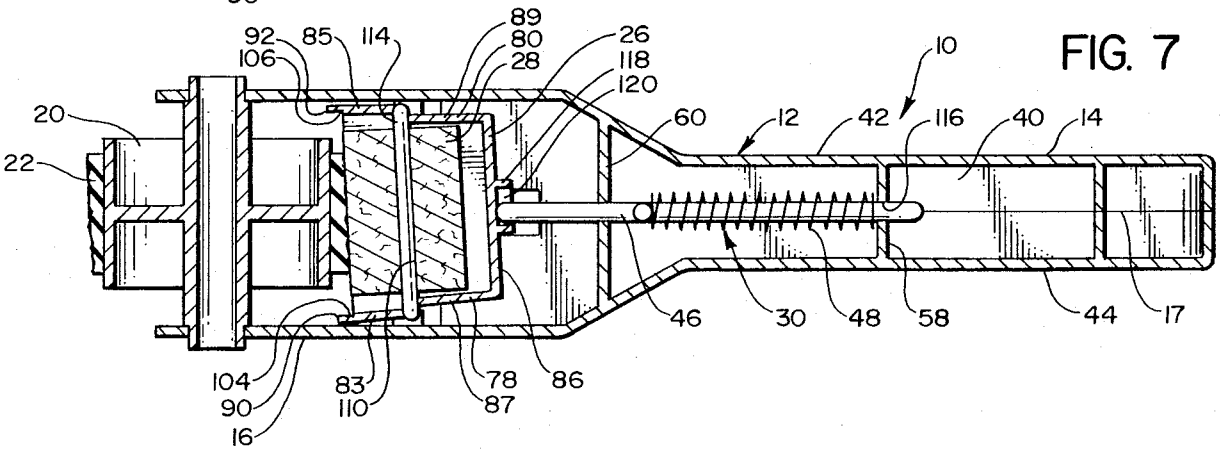
FIG. 7 is a side cross-sectional view taken through the longitudinal center axis showing the inking roller engaged with the print wheel and showing the limited movement in a lateral direction of the inking roller relative to the print wheel.

In FIGS. 6 and 7 it can be seen that the spring means 30 in the form of the crosspin 46 with a spring 48 therearound has one contact point 116 at the rear plate 58 of the handle 14 and one contact point 107 against the rear wall 86 of the ink housing 26. Positioned at the contact point 107 on the rear wall 86 of the ink housing 26 is a circular protrusion 118 defining a rearwardly facing socket 120 adapted to receive the forward end 50 of the crosspin 46 of the spring means 30. The print wheel 20 of the present printing device 10 is rotatably but rigidly mounted in the print wheel cavity 18. The single point pressure of the spring means 30 against the rear wall 86 of the ink housing 26 established at the contact point 107 allows the ink housing 26 to have limited free pivotal movement about the contact point 107 in all directions so that the inking roller 28 in the ink housing 26 is free to change its angular position relative to the print wheel 20. This is illustrated in FIG. 7. Thus, the inking roller 28 consistently inks the print wheel 20 so that the print wheel 20 does not skip in the printing of the pattern. The ink housing 26 also has some freedom of movement in a vertical direction to allow the snapping action of the upper edges 109 of the flange members 90 and 92 on the ink housing 26 into the notches 100 and 102.

In the method of the present invention the ink housing 26 is manipulated in the manner described above to move the ink housing 26 between its forward operating position to its retracted position, and back to its operating position. Also, the removable closure plate 94 is positioned on the open front portion 88 of the ink housing 26 when the inking roller is not in use.

From the foregoing it can be seen that the applicant's printing device for printing a continuous strip of indicia provides a printing device which is simple and clean to use. The print wheels and inking assemblies are quickly interchangeable so as to allow a variety of patterns in a variety of colors to be printed. Because the inking assembly is free to move relative to the print wheel, a high quality printed surface is provided. The applicant's printing device is also easy and inexpensive to manufacture having very few parts for its construction.

I claim:

1. A printing device for printing a continous strip of indicia on a material, the device having a forward end, a rear end, and a longitudinal center axis, the printing device comprising:

a. a housing comprising a handle and an operating end portion attached to the handle, the operating end portion defining a print wheel cavity;

b. a print wheel having an outer circumferential printing surface, adapted to be mounted in the housing in the print wheel cavity for rotation about a wheel axis;

c. an inking assembly comprising an ink housing and an inking roller rotatably mounted in the ink housing, the ink housing having an open front portion, the inking assembly being moveable between a first forward position where the inking roller is in contact with the print wheel and a second retracted position where the inking roller is spaced from the print wheel;

d. spring means mounted in the housing adapted to urge the inking roller toard the first forard position;

e. releasable retaining means adapted to hold the inking assembly in the second retracted position; and f. said ink housing having a substantially enclosed side wall and having an open front end, the inking assembly further comprising a removeable closure member, the closure member being adapted to be positioned on the open front portion of the ink housing when the ink housing is in the second retracted position.

2. The printing device as defined in claim 1 wherein the inking assembly is removable from the housing.

3. The printing device as defined in claim 2 wherein the ink housing has two side walls having front edge portions, and top and bottom walls having front edge portions, the front edge portions of the side walls extending beyond the front edge of at least one of the top and bottom walls to thereby form flanges, with the flanges defining a slideway for receiving the closure member.

4. The printing device as defined in claim 3 said releasable retaining means comprising:

f. catch means having a lower surface, the catch menas positioned in the housing; and g. matching notch means defined by the catch means positioned in the housing;

h. the releasable retaining means being arranged so that as the ink housing is moved rearwardly, end portions of the flanges bear against the lower surface of the catch means and move into the notch means to thereby hold the ink housing in the retracted position.

5. The printing device as defined in claim 1 wherein the inking roller has a center roller axis and has a hole positioned therethrough proximate to the center roller axis, wherein a shaft of similar diameter to that of the hole is positioned through the hole such that the inking roller is rigidly mounted in the ink housing.

6. The printing device as defined in claim 1 wherein the print wheel has an axle which is removably mounted to the operating end of the housing within the print wheel cavity, in a manner that the print wheel is adapted to be removed and replaced.

7. The printing device as defined in claim 1 wherein the operating end of the housing is arranged to enclose the print wheel cavity in a manner that a substantial portion of the circumferential printing surface which is out of contact with the material is enclosed.

8. The printing device as define in claim 1 wherein the releasable retaining means comprises:

i. a lever means positioned on the ink housing for moving the inking assembly away from the print wheel;

ii. a catch means positioned in the housing adapted to secure the inking assembly in its retracted position; and iii. said ink housing being moveable laterally to come into and out of engagement with said cathch means.

9. The printing device as defined in claim 8 wherein the lever means is positioned to receive a first rearward retracting force and the spring means exerts a forward force, the forward force being spaced laterally offset from the retracting force; whereby interaction of the forward force and the retracting force causes limited angular movement of the ink housing to come into engagement with the catch means.

10. The printing device as defined in claim 8 wherein the inking assembly further comprises a removable closure member adapted to be positioned on the open front portion of the ink housing and wherein the catch means further define slots for receiving the closure member.

11. The printing device as defined in claim 1 wherein the spring means presses against a rear wall of the ink housing at a single location in a manner to allow the ink housing to have limited movement in all directions so that the inking roller in the ink housing is free to change its angular position relative to the print wheel.

12. The printing device as defined in claim 1, wherein said ink housing has a pair of forwardly extending flanges, positioned oppositely from one another at the open front portion of the ink housing to define a slideway, the device further comprising a said closure member being adapted to move into said slideway to fit over the open front portion of the housing.

13. The device as defined in claim 12, wherein the retaining means comprises catch means adapted to engage the ink housing when the ink housing is in the retracted position, the catch means being arranged to leave the slideway unobstructed when the ink housing is in the retracted position so that the closure member can be moved into the slideway.

14. The device as defined in claim 13, wherein the catch means comprises a pair of catch members positioned oppositely from one another on the housing, the catch members adapted to interengage the flanges to retain the ink housing in the retracted position.

15. The printing device as defined in claim 14, wherein there is a lever means connected to the ink housing and arranged to be manually engaged to have a rearwardly directed force applied thereto to move the ink housing in a rearward direction, the spring means being positioned to exert a forward force against the ink housing, the forward force being laterally offset from the rearwardly directed force applied against the lever means to cause limited angular movement of the ink housing to place said flanges into engagement with the catch means.

16. A printing device for printing a continuous strip of indicia on a material, the device having a forward end, a rear end, and a longitudinal center axis the printing device comprising:

a. a housing comprising a handle and an operating end portion attached to the handle, the operating end portion defining a print wheel cavity;

b. a print wheel having an outer circumferential printing surface, adapted to be mounted in the housing in the print wheel cavity for rotation about a wheel axis;

c. an inking assembly comprising an ink housing and an inking roller rotatably mounted in the ink housing, the ink housing having an open front portion, the inking assembly being moveable between a first forward position where the inking roller is in contract with the print wheel and a second retracted postion where the inking roller is spaced from the print wheel;

d. spring means mounted in the housing adapted to urge the inking roller toward the first forward position;

e. releasable retaining means positioned on the ink housing adapted to hold the inking assemble in the second retracted position, said releasable retaining means comprising:

i. a lever means positioned on the ink housing for moving the inking assembly away from the print wheel;

ii. a catch means postioned in the housing adapted to secure the inking assembly in its retracted position; and iii. said ink housing being moveable laterally to come into and out of engagement with said catch means.

17. The printing device as defined in claim 16 wherein the lever means is positioned to receive a first rearward retracting force and the spring means exerts a foward force, the forward force being spaced laterally offset from the retracting force, whereby interaction of the forward force and the retracting force causes limited angular movement of the ink housing to come into engagement with the catch means.

18. The printing device as definedin claim 16 wherein the inking assembly further comnprises a removable closure member adapted to be positioned on the open front portion of the ink housing and wherein the catch means further define slots for receiving the closure member.

* * * * *